United States Patent [19]

Bornand

[11] 3,951,037

[45] Apr. 20, 1976

[54] PROJECTILE LAUNCHING DEVICE

[75] Inventor: Robert M. Bornand, Meyrin, Switzerland

[73] Assignee: Valinor Anstalt, Vaduz, Liechtenstein

[22] Filed: Oct. 16, 1973

[21] Appl. No.: 406,928

[30] Foreign Application Priority Data

Oct. 10, 1973 Switzerland ..... 14409/73

[52] U.S. Cl. ..... 89/1 F; 102/49.2

[51] Int. Cl.[2] ..... F42B 13/26

[58] Field of Search ..... 89/1 F, 1 J; 102/40, 102/49.2

[56] References Cited

UNITED STATES PATENTS

| | | | |
|---|---|---|---|
| 562,535 | 6/1896 | Hurst | 102/40 |
| 1,347,125 | 7/1920 | Schneider | 89/1 F |
| 3,134,330 | 5/1964 | Batou | 89/1 F X |
| 3,500,715 | 3/1970 | Batou | 89/1 F |
| 3,505,924 | 4/1970 | Driscoll | 89/1 F |
| 3,789,763 | 2/1974 | Donner | 102/49.2 |

*Primary Examiner*—Stephen C. Bentley
*Attorney, Agent, or Firm*—Young & Thompson

[57] ABSTRACT

The invention pertains to a projectile launching device of the type comprising a tubular tail containing a first charge with primer and having vents therein communicating with a second charge surrounding the corresponding part of said tail, said first charge being intended to be ignited by a launching tube having a bottom provided with a firing pin in which said tubular tail further comprises a means for igniting said second charge when the projectile is already set in motion by said first charge.

2 Claims, 7 Drawing Figures

PROJECTILE LAUNCHING DEVICE

At present, essentially two types of tubes for launching projectiles are known: the first, with open chamber is noisy with visible glow and smoke; the second is noiseless, without visible flame or smoke. Nevertheless, whatever propulsion device is used, once the projectiles are launched their behavior in overcoming air resistance is governed by the same laws. Likewise, there is only one optimum velocity for a given system.

In the first type of launching device, in order to obtain this optimum velocity, all the powder is ignited upon priming. This results in maximum pressure and, hence, the need to use a thick walled launching tube, which again means a large ammunition-weapon weight.

According to the equations of mechanics and exterior ballistics and for a given maximum efficient velocity, weight reduction of the ammunition brings about a diminution of the muzzle energy and an increase in air resistance, that is to say, also a decrease of the range.

It is thus necessary to try to reduce the weight of the weapon without modifying the weight of the ammunition.

It is possible to use materials whose weight/mechanical resistance ratio is more favorable, but unfortunately this generally involves prohibitive prices. One could also contemplate shortening the launching tube, but this solution implies increasing the thickness of the latter considering that, to obtain the same muzzle energy, the energy of combustion, respectively the pressure within the tube, must be increased.

The essential object of the present invention is, for a given length of tube to appreciably reduce the wall thickness thereof correlative to an appreciable diminution of the pressure inside the tube. This object is achieved by the fact that, in a projectile launching device of the type comprising a tubular tail containing a first charge with primer and having vents therein communicating with a second charge surrounding the corresponding part of said tail, said first charge being intended to be ignited by a launching tube having a bottom provided with a firing pin, said tubular tail further comprises a means for igniting said second charge when the projectile has already been set in motion by said first charge. Indeed, it has been found that, if the second charge is ignited when the projectile already has a certain velocity, higher muzzle velocities are obtained for the same pressures. That is to say, if the velocity acquired at the moment of ignition is not zero, lower pressures are obtained for the same muzzle velocity depending on the velocity acquired at the moment of ignition.

To better explain the characteristics of the launching device according to the invention, one embodiment thereof is described in detail hereinafter, reference being made to the appended drawings, wherein.

Figure 1:
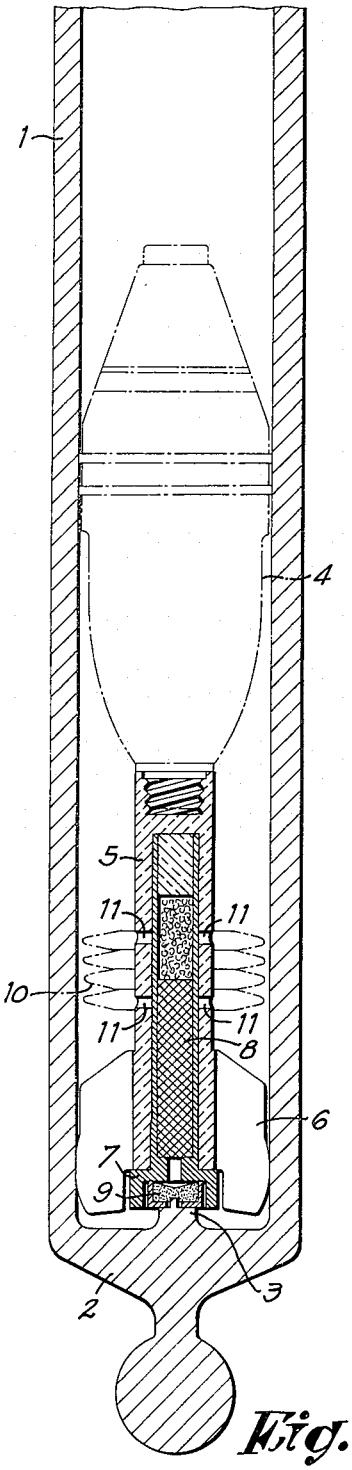
FIG. 1 is a longitudinal section of a known launching device.

As shown in FIG. 1, representing a classic device, the launching tube 1 of relatively thick steel wall has a bottom 2 provided with a firing pin 3. The projectile consists of a head 4 extended by a cylinder 5 equipped with stabilizing fins 6. Located within cylinder 5 is a cartridge 7 partially filled with powder 8 and the sealed rear part of which encloses a primer 9. Booster charges 10 are placed at the exit of vents 11 drilled into said cylinder 5.

To launch the projectile it is sufficient to let it fall in the launching tube in the familiar manner. At the end of the drop, the primer 9 crashes against the firing pin 3. This results in ignition and combustion of the powder 8, which causes instantaneous opening of the vent holes 11 by shattering of the corresponding parts of the case of cartridge 7 and in ignition of the booster charges 10. The two charges, 8 and 10 respectively release the propulsive energy needed to start the projectile while a very high pressure develops inside the tube 1.

It will be observed in particular that ignition of the booster charges occurs at the same time that the gases of the first charge expand. In other words, at the moment said booster charges are ignited, the projectile is still immobile in the launching tube.

Figure 2:
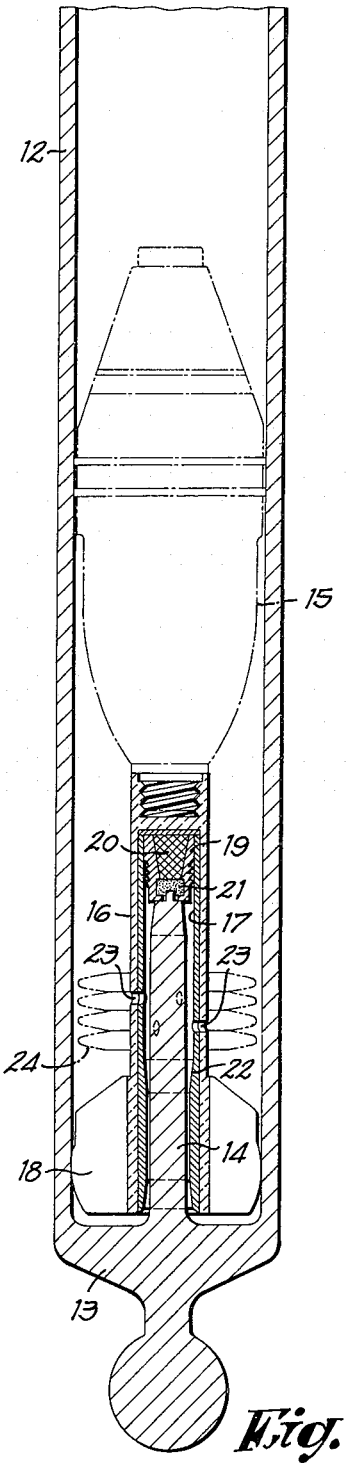
FIG. 2 shows a longitudinal section of a launching device according to the invention, the projectile and launching device being shown at the instant preceding ignition of the first inner charge.
Figure 3:
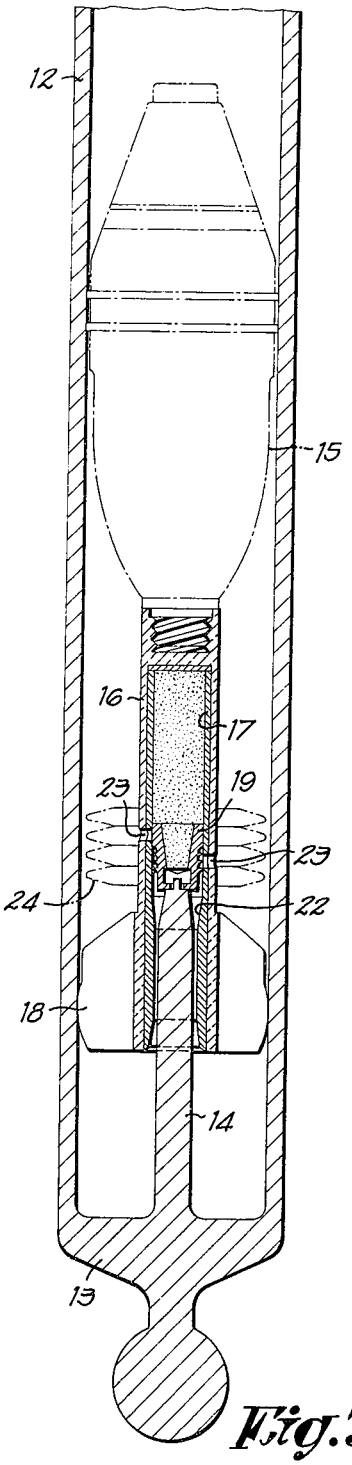
FIG. 3 is similar to FIG. 2, the projectile and the launching device being however shown in a phase intermediate between ignition of the first charge and ignition of the second charge.
Figure 4:
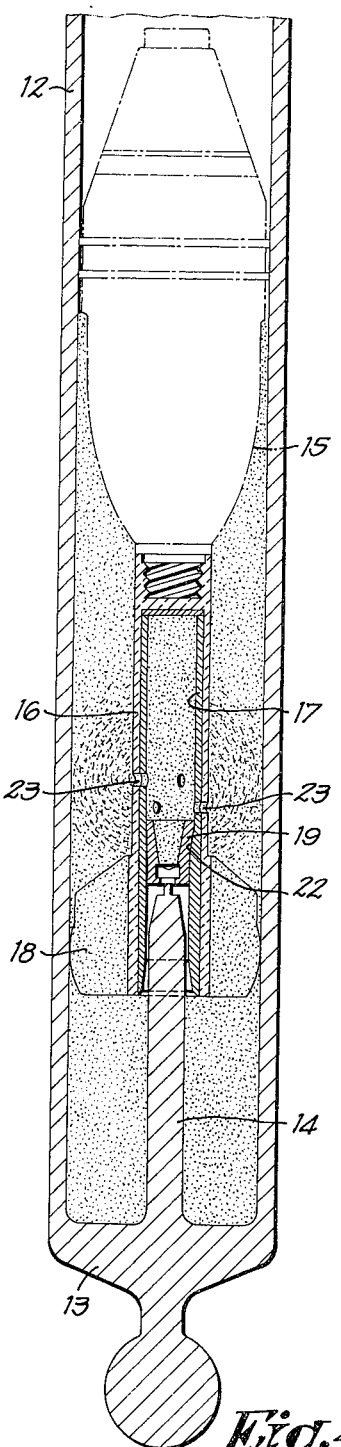
FIG. 4 is similar to FIGS. 2 and 3, the device and projectile being shown in the phase subsequent to ignition of the second charge.

In the example of a launching device according to the invention, such as shown in FIGS. 2 to 4, use is made of a steel launching tube 12 with a relatively thin wall and whose bottom 13 is provided with an axial rod forming a striker 14. In this particular case, the projectile comprises a head or bomb 15 extended by a double-walled tubular tail 16–17 provided with stabilization fins 18. Placed in the upper part of said tubular tail is a piston 19, in this example of frusto-conical shape, filled with powder respectively with a charge 20, its bottom enclosing a primer 21. The inner wall 17 is built with a conic abutment or seat 22 intended to receive and immobilize said piston 19 in the first phase of the projectile's launching. The above-mentioned concentric walls 16–17 are pierced with vent holes 23 communicating with booster charges 24. In this embodiment, when the projectile drops in the launching tube 12, the primer 21 comes into violent contact with the striker 14. The resulting expansion of gas moves the projectile in the launching tube 12 (FIG. 3). The piston 19 wedges itself firmly in the seat 22. In this position, the vent holes 23 are accessible to the gases which then bring about ignition of the booster charges 24, the projectile being already in motion. From now on, the projectile is simultaneously acted upon by expanding gases originating from the two charges 20, 24. The pressure that develops in the launching tube 12 is appreciably less than in the classic case shown in FIG. 1, so that a launching tube with relatively thin walls, that is one of minimal weight, can be used.

Figure 5:
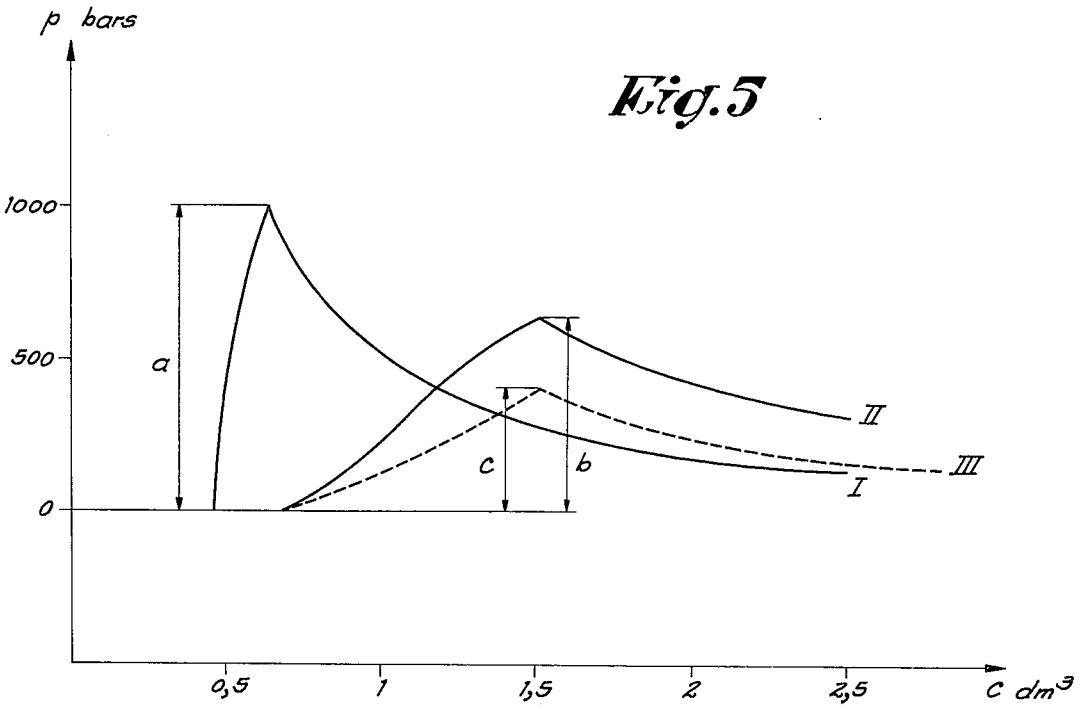
FIG. 5 is a comparative diagram of the pressures obtained, in the first instance, in a classic mortar, secondly, when using a launching device according to the invention, and, thirdly by using the same device but with a longer tube.

The advantage of this arrangement unquestionably appears from a comparison of the curves shown in the diagram of FIG. 5, wherein curve I refers to launching of a projectile by means of a classic device (FIG. 1), curve II to launching of the same projectile with a tube of the same length by means of the device according to the invention (FIGS. 2, 3 and 4), and curve III to launching of the same projectile by means of the same device but with a longer tube.

Ordinate *b* of curve II relating to launching of the projectile with a device according to the invention is, in this example, approximately ⅔ of ordinate *a* relative to the pressure curve I referring to use of the classic launching device.

Thus a drop in pressure of the order of ⅓ is recorded. This diminution of the pressure entails a reduction in the longitudinal and transverse stresses on the launching tube. The result is that the wall thickness of the latter can easily be reduced. Similarly, the gradient of the force of recoil being reduced considering that the acceleration of the projectile is produced in two phases separated in time, it is also possible to diminish the weight of the mounting, for example, the base plate in the case of a mortar.

Therefore, for a same muzzle force, a marked reduction in the weight of the weapon results.

The muzzle pressure could further be reduced, for example, by using a longer tube, which would reduce the expansion represented by curve II to the desired muzzle pressure represented, for example, by curve III. This necessarily results in an increase in the initial velocity, which leads to the consideration of two particular cases. In the first, the initial velocity is considered as becoming greater than the subsonic speed limit. In this case, it would be suitable to reduce the powder charge corresponding to curve II, which would have the effect of lowering this curve until the optimum predetermined velocity is reached. In this case, calculation shows that, for a same muzzle pressure, a same initial velocity, and a same charge, the reduction of the pressure passes from 30 to 60%, i.e. the maximum pressure inside the tube is reduced to 40% of the pressure obtained in the classic case. Indeed, curve III of FIG. 5 shows that the pressure at *c* is 40% of the pressure at *a*. On the other hand, if, for example, a 17% increase of the length of the tube is adopted, the same muzzle pressure and velocity are obtained. Under these conditions, the thickness of the tube can be diminished still more, which again reduces the weight of the weapon.

In the second case, considering that the initial velocity remains below or equal to the exterior ballistics velocity limit, by increasing the length of the tube the device according to the invention can be exploited further for more advantageous conditions. Indeed, as an example, it can be considered that, for an 8% increase in the length of the tube and with the identical muzzle pressure, the maximum pressure is diminished by 50%.

Figure 6:
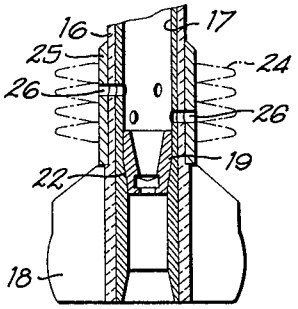
FIGS. 6 and 7 represent in longitudinal section and in two characteristic positions, a means for launching the projectile either with open chamber or with closed chamber, respectively.
Figure 7:
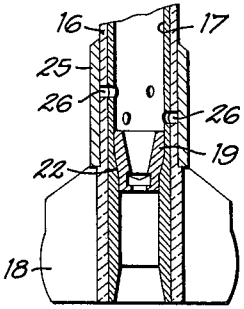

Still another characteristic of the invention consists of the fact that the launching device can very easily be arranged to make it a hybrid of sorts, conditioning it to permit launching the projectile either by closed chamber or open chamber thus combining the advantages of two known systems. For this purpose, as shown in FIGS. 6 and 7, it is sufficient to surround the tubular tail 16–17 at the level of the vent holes 23, i.e. also that of the booster charge 24, with a collar 25 provided with holes 26, so that by simple rotation it can either mask or free the said vent holes 23 of the cylindrical tail. In effect, if the vent holes are freed, the launching device functions as described above. On the other hand, if the collar 25 is positioned by simple rotation to mask the vent holes 23, the projectile is propulsed exclusively by the combustion of charge 20.

The invention concerns and a launching device as hereabove described and any projectile and launching tube conditioned to apply this device.

What is claimed is:

1. In combination, a projectile and a launching tube therefor, the projectile having a tubular tail portion housing a first explosive charge and a primer for detonating said first explosive charge, a piston axially movable in said tubular tail portion over a limited length under the effect of said first charge when fired, said launching tube slidably receiving said projectile, an axially extending central guiding rod upstanding from the bottom of said launching tube and receivable in said tubular tail portion of said projectile, said guiding rod being slightly longer than the free inner space of said tail portion and having a firing pin at its end to strike said primer, said tail portion having lateral vents therethrough at a height between the ends of the path of movement of said piston in said tubular tail portion, a second charge carried by said projectile surrounding said tail portion and ignitible by said first charge through said vents, and a sleeve rotatable on said tubular tail portion and having holes therethrough registrable with said vents selectively to open or close said vents by simple rotation of said sleeve.

2. Apparatus as claimed in claim 1, said tubular tail portion having a seat comprising a progressive reduction of the inside diameter of said tail portion thereby to limit movement of said piston after said first charge is fired, said seat being of frustoconical shape.

* * * * *